US006389714B1

(12) United States Patent
Mack

(10) Patent No.: US 6,389,714 B1
(45) Date of Patent: May 21, 2002

(54) SHOE HAVING RETRACTABLE SPIKES

(76) Inventor: James Mack, 124 Columbia Heights, Brooklyn, NY (US) 11201

( * ) Notice: Subject to any disclaimer, the term of this patent is extended or adjusted under 35 U.S.C. 154(b) by 0 days.

(21) Appl. No.: 09/849,795

(22) Filed: May 7, 2001

(51) Int. Cl.[7] ..... A43C 15/00
(52) U.S. Cl. ..... 36/61; 36/100
(58) Field of Search ..... 36/61, 100

(56) References Cited

U.S. PATENT DOCUMENTS

| | | | | | |
|---|---|---|---|---|---|
| 264,105 | A | * | 9/1882 | Rust | 36/61 |
| 1,487,976 | A | * | 3/1924 | Rossi et al. | 36/61 |
| 2,920,404 | A | * | 1/1960 | Ross | 36/61 |
| 3,717,238 | A | * | 2/1973 | Fox | 36/61 |
| 5,870,838 | A | * | 2/1999 | Khayat | 36/61 |
| 5,956,870 | A | * | 9/1999 | Grossman et al. | 36/61 |

FOREIGN PATENT DOCUMENTS

| | | | | |
|---|---|---|---|---|
| FR | 1115272 | * | 12/1955 | 36/61 |
| FR | 1116046 | * | 1/1956 | 36/61 |

* cited by examiner

*Primary Examiner*—M. D. Patterson
(74) *Attorney, Agent, or Firm*—Goldstein Law Offices, P.C.

(57) ABSTRACT

A shoe having retractable spikes including a shoe portion comprised of a sole portion having a heel portion and a toe portion. The heel portion and the toe portion each have a plurality of apertures therethrough in a spaced relationship. A pair of plates are disposed within the hollow interior of the sole portion. The pair of plates each have a plurality of spikes extending downwardly therefrom in a spaced relationship. The plurality of spikes are aligned with the plurality of apertures of the heel portion and the toe portion of the sole portion. The pair of plates each have a pair of springs extending downwardly therefrom which bias the plate upward. A deployment mechanism provides an extended orientation whereby the pair of plates extend downwardly against the biasing of the springs with the spikes extending through the apertures.

3 Claims, 3 Drawing Sheets

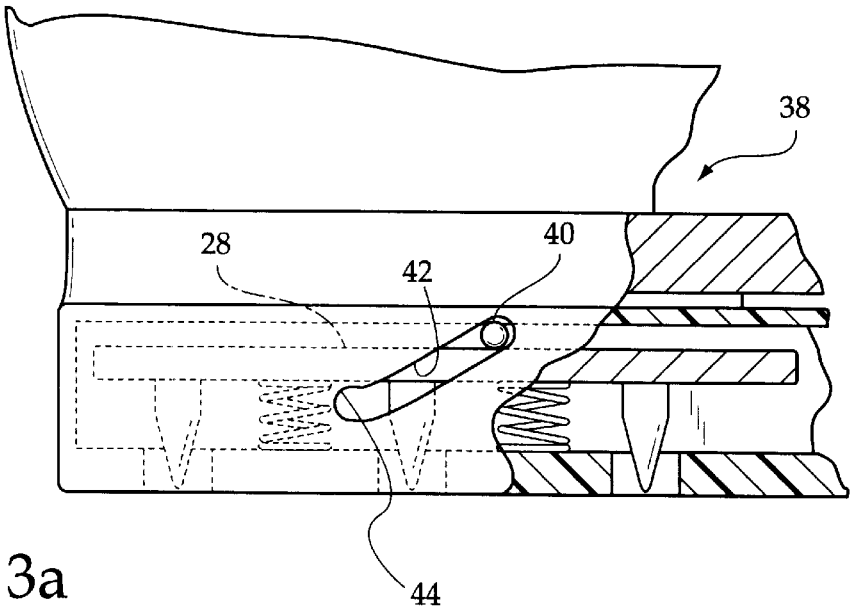
Fig. 3a
Fig. 3b
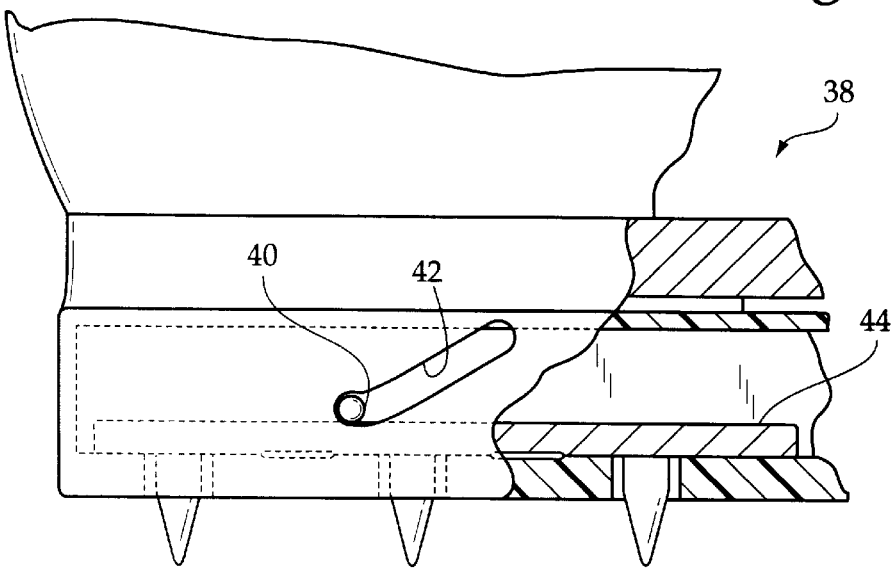

SHOE HAVING RETRACTABLE SPIKES

CROSS REFERENCES AND RELATED SUBJECT MATTER

This application relates to subject matter contained in patent application Ser. No. 09/591,414, filed in the U.S. Patent Office on Jun. 10, 2000.

BACKGROUND OF THE INVENTION

The present invention relates to a shoe having retractable spikes and more particularly pertains to utilizing spikes when needed and being able to retract them when not needed.

The use of shoe accessory devices is known in the prior art. More specifically, shoe accessory devices heretofore devised and utilized for the purpose of customizing shoes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,737,855 to Jordan discloses an athletic shoe with means to retract the spikes into the outsole housing using manually slidable spike plates. U.S. Pat. No. 5,815,951 Jordan discloses a shoe with retractable spikes using a liquid inflated bladder arrangement. U.S. Pat. No. 5,732,482 to Remington discloses a spring biased spike capable of manually extending and retracting.

While these devices fulfill their respective, particular objective and requirements, the aforementioned patents do not describe a shoe having retractable spikes for utilizing spikes when needed and being able to retract them when not needed.

In this respect, the shoe having retractable spikes according to the present invention substantially departs from the conventional concepts and designs of the prior art, and in doing so provides an apparatus primarily developed for the purpose of utilizing spikes when needed and being able to retract them when not needed.

Therefore, it can be appreciated that there exists a continuing need for a new and improved shoe having retractable spikes which can be used for utilizing spikes when needed and being able to retract them when not needed. In this regard, the present invention substantially fulfills this need.

SUMMARY OF THE INVENTION

In the view of the foregoing disadvantages inherent in the known types of shoe accessory devices now present in the prior art, the present invention provides an improved shoe having retractable spikes. As such, the general purpose of the present invention, which will be described subsequently in greater detail, is to provide a new and improved shoe having retractable spikes which has all the advantages of the prior art and none of the disadvantages.

To attain this, the present invention essentially comprises a shoe portion comprised of an open upper end for receiving a foot therein and a closed lower end. A sole portion is secured to the closer lower end of the shoe portion. The sole portion has a hollow interior. The sole portion if comprised of a heel portion and a toe portion. The heel portion and the toe portion each have a plurality of apertures therethrough in a spaced relationship. A pair of plates are disposed within the hollow interior of the sole portion. The pair of plates include a heel plate and a toe plate corresponding with the heel portion and the toe portion of the sole portion. The pair of plates each have a plurality of spikes extending downwardly therefrom in a spaced relationship. The plurality of spikes are aligned with the plurality of apertures of the heel portion and the toe portion of the sole portion. The pair of plates each have a pair of springs extending downwardly therefrom. The springs each have lower ends coupling with the heel portion and the toe portion of the sole portion, respectively. The springs bias the pair of places upwardly whereby the spikes are disposed within the hollow interior of the sole portion. A pair of deployment mechanisms are disposed within the sole portion. The deployment mechanisms each have a slot in the sole portion, and a sliding rod extending laterally across the plates and out of the sole portion through the slot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shoe having retractable spikes which has all the advantages of the prior art shoe accessory devices and none of the disadvantages.

It is another object of the present invention to provide a new and improved shoe having retractable spikes which may be easily and efficiently manufactured and marketed.

It is a further object of the present invention to provide a new and improved shoe having retractable spikes which is of durable and reliable construction.

An even further object of the present invention is to provide a new and improved shoe having retractable spikes which is susceptible of a low cost of manufacture with regard to both materials and labor, and which accordingly is then susceptible of low prices of sale to the consuming public, thereby making such a shoe having retractable spikes economically available to the buying public.

Even still another object of the present invention is to provide a new and improved shoe having retractable spikes for utilizing spikes when needed and being able to retract them when not needed.

Lastly, it is an object of the present invention to provide a new and improved shoe having retractable spikes including a shoe portion comprised of an open upper end for receiving a foot therein and a closed lower end. A sole portion is secured to the closed lower end of the shoe portion. The sole portion has a hollow interior. The sole portion is comprised of a heel portion and a toe portion. The heel portion and the toe portion each have a plurality of apertures therethrough in a spaced relationship. A pair of plates are disposed within the hollow interior of the sole portion. The pair of plates include a heel plate and a tope plate corresponding with the heel portion and the toe portion of the sole portion. The pair of plates each have a plurality of spikes extending downwardly therefrom in a spaced relationship. The plurality of spikes are aligned with the plurality of apertures of the heel portion and the toe portion of the sole portion. The pair of plates each have a pair of springs extending downwardly therefrom. The springs each have lower ends coupling with the heel portion and the toe portion of the sole portion. The springs bias the pair of plates upwardly whereby the spikes are disposed within the hollow interior of the sole portion. A pair of deployment mechanisms are disposed within the sole portion. The deployment mechanisms each have an extended orientation whereby the pair of plates extend downwardly against the biasing of the springs with the spikes extending through the apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3*a* is a side elevational view, with parts broken away, of the present invention illustrating the deployment mechanism thereof, wherein the spikes are in a retracted position.

FIG. 3*b* is a side elevational view, with parts broken away, similar to FIG. 3*a*, except wherein the spikes are in a deployed position.

The same reference numerals refer to the same parts through the various figures.

DESCRIPTION OF THE PREFERRED EMBODIMENT

Figure 1:
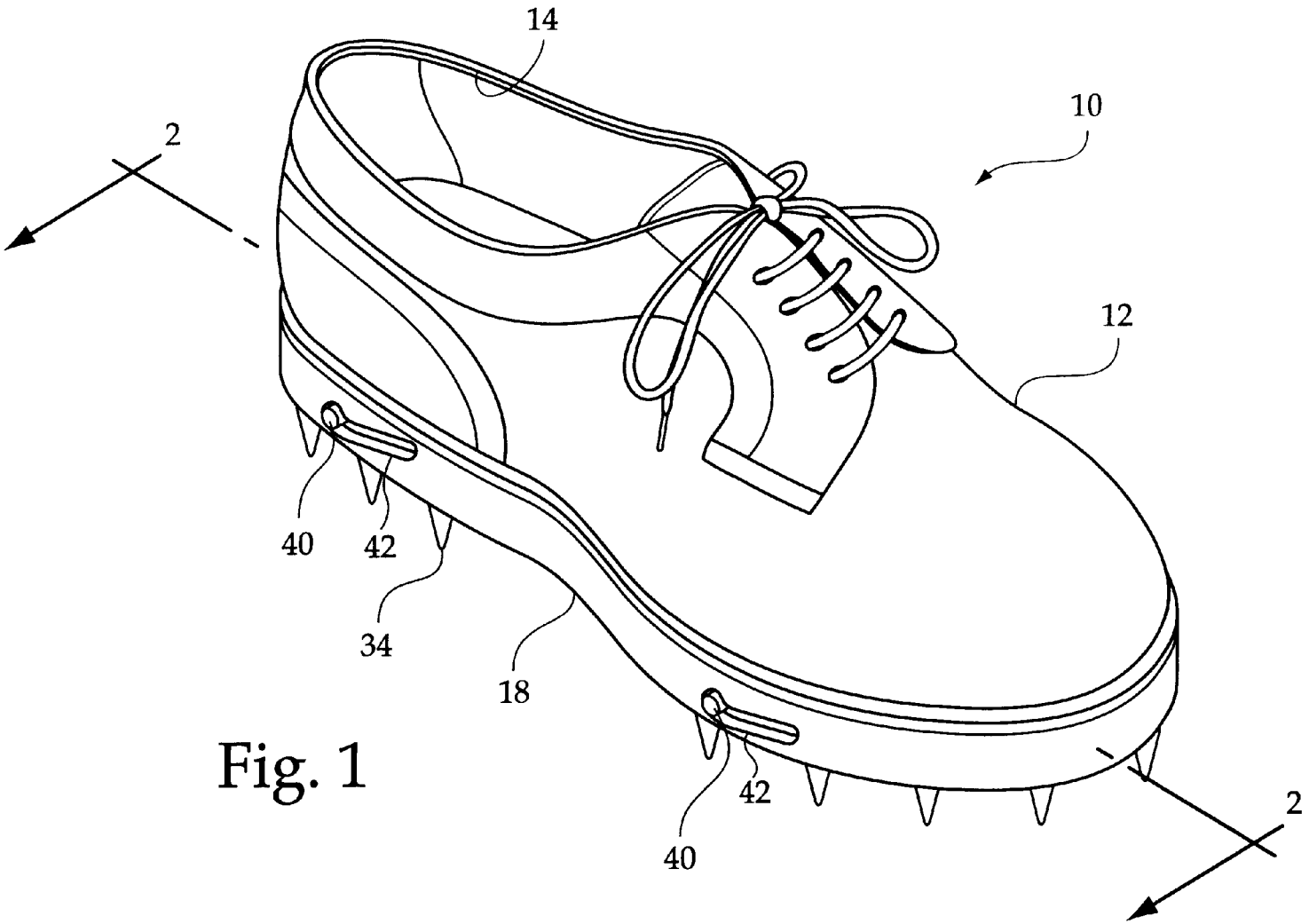
FIG. 1 is a perspective view of the preferred embodiment of the shoe having retractable spikes constructed in accordance with the principles of the present invention.
Figure 2:
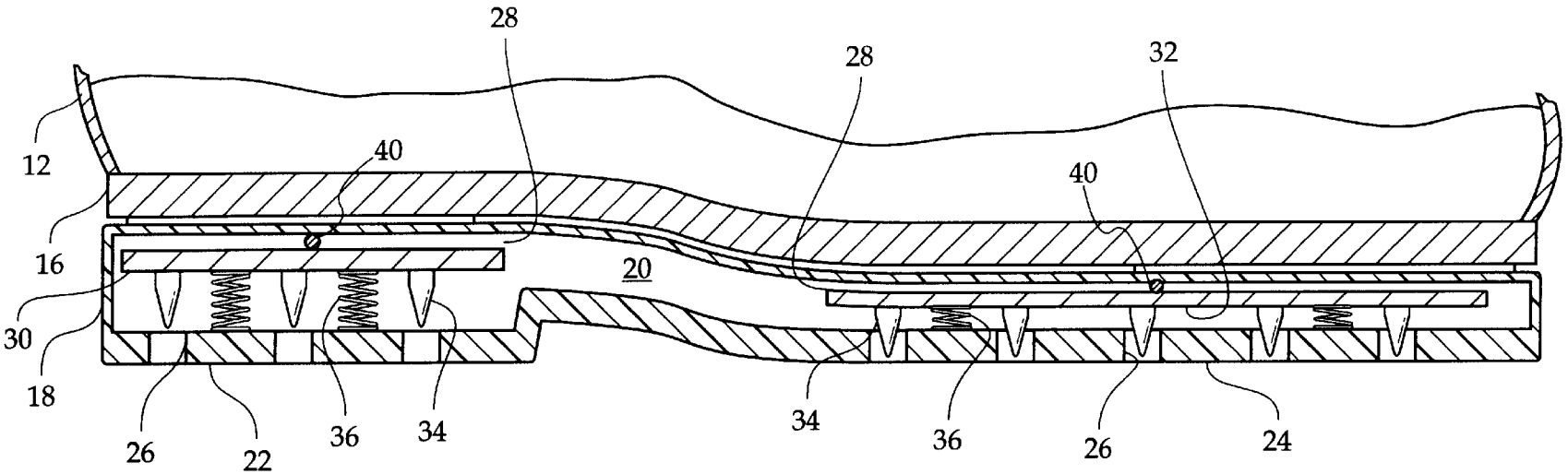
FIG. 2 is a cross-sectional view of the present invention as taken along line 2—2 of FIG. 1.

With reference now to the drawings, and in particular, to FIGS. 1 and 2 thereof, the preferred embodiment of the new and improved shoe having retractable spikes embodying the principles and concepts of the present invention and generally designated by the reference number 10 will be described.

Specifically, it will be noted in the various Figures that the device relates to a shoe having retractable spikes for utilizing spikes when needed and being able to retract them when not needed. In its broadest context, the device consists of a shoe portion, a sole portion, a pair of plates, and a pair of deployment mechanisms. Such components are individually configured and correlated with respect to each other so as to attain the desired objective.

The shoe portion 12 is comprised of an open upper end 14 for receiving a foot therein and a closed lower end 16. The shoe portion 12 can be designed in any fashion known in the art.

The sole portion 18 is secured to the closed lower end 16 of the shoe portion 12. The sole portion 18 has a hollow interior 20. The sole portion 18 is comprised of a heel portion 22 and a toe portion 24. The heel portion 22 and the toe portion 24 each have a plurality of apertures 26 therethrough in a spaced relationship.

The pair of plates 28 are disposed within the hollow interior 20 of the sole portion 18. The pair of plates 28 include a heel plate 30 and a toe plate 32 corresponding with the heel portion 22 and the toe portion 24 of the sole portion 18. The pair of plates 28 each have a plurality of spikes 34 extending downwardly therefrom in a spaced relationship. The plurality of spikes 34 are aligned with the plurality of apertures 26 of the heel portion 22 and the toe portion 24 of the sole portion 18. The pair of plates 28 each have a pair of springs 36 extending downwardly therefrom. The springs 36 each have lower ends coupling with the heel portion 22 and the toe portion 24 of the sole portion 18. The springs 36 bias the pair of plates 28 upwardly whereby the spikes 34 are disposed within the hollow interior 20 of the sole portion 18.

The pair of deployment mechanisms 38 are disposed within the sole portion 18. The deployment mechanisms 38 each have a sliding rod 40 extending laterally across the sole portion 18. Each of the sliding rods 40 extend laterally across and immediately above one of the pair of plates 28, as seen in FIG. 2. The deployment mechanisms 38 have an extended orientation whereby the pair of plates 28 extend downwardly against the biasing of the springs 36 with the spikes 34 extending through the apertures 26 of the sole portion 18. To place the deployment mechanisms 38 into the extended orientation, the user simply slides the sliding rods 40 diagonally downward through the slot 42 to move the plates 28 downward. The slots 42 have a lock notch 44, wherein once its associated rod 40 is slid fully downward, it may enter the lock notch 44 whereby the plates 28 are held in a downward orientation with the spikes 34 positioned through the apertures 26 of the sole portion 18, and pressure upon the spikes 34 simply urges the rod 40 against the lock notch 44.

Referring to FIGS. 3*a* and 3*b*, the sliding rod 40 extends laterally outward through the slots 42. Accordingly, for each sliding rod 40, a pair of slots 42 is preferably employed, for a total of four slots 42. The slots 42 extend diagonally downward to facilitate extension of the spikes with minimum effort, using the principle of an inclined plane. Accordingly, each sliding rod 40 extends laterally across the shoe, and extends out one of the slots 42 on each of the two sides. FIGS. 3*a* and 3*b* illustrate the extended or deployed position (FIG. 3*b*), and the retracted position for the spikes (FIG. 3*a*). Further illustrated is the manner in which each sliding rod 40 may be manipulated to extend the spikes, and may be locked into position using the lock notch 44 of that slot 42.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A shoe having retractable spikes for utilizing spikes when needed and being able to retract them when not needed comprising, in combination:

a shoe portion comprised of an open upper end for receiving a foot therein and a closed lower end;

a sole portion secured to the closed lower end of the shoe portion, the sole portion having a hollow interior, the sole portion being comprised of a heel portion and a toe portion, the heel portion and the toe portion each having a plurality of apertures therethrough in a spaced relationship;

a pair of plates disposed within the hollow interior of the sole portion, the pair of plates including a heel plate and a toe plate corresponding with the heel portion and the toe portion of the sole portion, the pair of plates each having a plurality of spikes extending downwardly therefrom in a spaced relationship, the plurality of spikes being aligned with the plurality of apertures of the heel portion and the toe portion of the sole portion, the pair of plates each having a pair of springs extending downwardly therefrom, the springs each having lower ends coupling with the heel portion and the toe portion of the sole portion, the springs biasing the pair of plates upwardly whereby the spikes are disposed within the hollow interior of the sole portion; and a pair of deployment mechanisms disposed within the sole portion, the deployment mechanisms each having a sliding rod extending laterally above and across one of the pair of plates such that each sliding rod extends out of the sole portion on opposite sides of the shoe, whereby each sliding rod is selectively used to urge one of the pair of plates extend downwardly against the biasing of the springs with the spikes extending through the apertures of the sole portion, each deployment mechanism further comprising a pair of slots extending into the sole portion, such that one of the sliding rods extends through each of said slots, the slots extending diagonally downward, such that the sliding rod may be pushed downward in its associated slot to urge one of the pair of plates downward.

2. The shoe as recited in claim 1, wherein a pair of slots is associated with each of the sliding rods, located on opposite sides of the shoe, such that each sliding rod extends laterally outward from opposite sides of the shoe through one of said slots.

3. The shoe as recited in claim 2, wherein each slot has a locking notch, so that when the sliding rod is pushed fully downward in said slot, the sliding rod may rest in said locking notch so that the plate is held in position.

* * * * *